US005343373A

United States Patent [19]

Tillotson

[11] Patent Number: 5,343,373

[45] Date of Patent: Aug. 30, 1994

[54] SUSPENDED UP/DOWN LIGHT

[75] Inventor: Kevin Tillotson, Tupelo, Miss.

[73] Assignee: Thomas Industries, Inc., Tupelo, Miss.

[21] Appl. No.: 20,305

[22] Filed: Feb. 19, 1993

[51] Int. Cl.[5] ..... F21V 7/12

[52] U.S. Cl. ..... 362/217; 362/260; 362/297; 362/301; 362/346

[58] Field of Search ..... 362/217, 227, 235, 260, 362/297, 346, 404, 408

[56] References Cited

U.S. PATENT DOCUMENTS

| | | | |
|---|---|---|---|
| 2,198,096 | 4/1940 | Sweet . | |
| 2,284,046 | 5/1942 | Doane . | |
| 3,158,327 | 11/1964 | Dameral . | |
| 3,349,237 | 10/1967 | Jackson | 362/219 |
| 3,384,743 | 5/1968 | Little et al. . | |
| 4,277,820 | 7/1981 | Bostonian | 362/235 |
| 4,388,675 | 6/1983 | Lewin . | |
| 4,747,027 | 5/1988 | Rieger | 362/217 |
| 4,748,547 | 5/1988 | Baker | 362/217 |
| 4,876,633 | 10/1989 | Engel . | |
| 4,933,820 | 6/1990 | Engel . | |
| 4,980,808 | 12/1990 | Lilos | 362/219 |

FOREIGN PATENT DOCUMENTS

| | | | |
|---|---|---|---|
| 0061526 | 10/1982 | European Pat. Off. . | |
| 3346786 | 8/1985 | Fed. Rep. of Germany . | |
| 1341122 | 1/1964 | France . | |
| 526357 | 9/1940 | United Kingdom . | |
| 571042 | 8/1945 | United Kingdom | 362/217 |
| 672924 | 5/1952 | United Kingdom . | |

OTHER PUBLICATIONS

Advertisement, "Louvered Continuous Lighting", Feb. 5, 1940.

*Primary Examiner*—Ira S. Lazarus
*Assistant Examiner*—L. Heyman
*Attorney, Agent, or Firm*—Hill, Steadman & Simpson

[57] ABSTRACT

A housing for a tubular lamp having a generally rectangular configuration with parallel side walls and end walls forming a box with an open top and bottom. The side walls provide a channel at a bottom end and an inwardly directed flange at a top end along their length. A V-shaped reflector having straight segments with horizontally turned end portions is resiliently inserted against each side wall where one of the horizontally turned end portions presses against the inwardly directed top flange and the opposite end portion of the reflector fits into the channel. The invention provides for quick assembly and change-out of reflectors depending on conditions.

23 Claims, 1 Drawing Sheet

SUSPENDED UP/DOWN LIGHT

BACKGROUND OF THE INVENTION

The present invention relates to a lamp housing, and in particular to a horizontally suspended tubular lamp housing which provides specially designed side reflectors for directing light both upward and downward with respect to the housing.

Tubular lamp housings having side reflectors for reflecting light both up and down are known such as U.S. Pat. No. 3,158,327 and U.S. Pat. No. 2,284,046. However, the former patent comprises a complicated structure for retaining cusp-shaped reflectors in a parabolic-shaped housing. The latter patent does not disclose housing structure in detail. The reflectors disclosed are curved reflectors facing the tubes.

SUMMARY OF THE INVENTION

The invention provides a four-sided housing open at the top and bottom for holding tubular lamps therein, wherein two reflectors are snapped into place along an inside of opposite side walls to direct light both upwardly and downwardly. Each of the reflectors is held in place by abutting a top flange of the respective side wall above and by being trapped in an inwardly directed channel lip of the respective side wall below. The reflectors have a straight segment V-shape pointing laterally inward toward the tubular lamps. One or both of the segments can have a bent-off distal end region which abuts the top and/or bottom flange flushly.

The present invention provides a simple, easily constructed and assembled rectangular lamp shroud assembly providing for an easy snap-in connection of the two lateral reflectors. The reflectors can be easily bent and formed sheet metal, treated to have proper surface reflectivity. The reflectors can be slightly resiliently compressed to fit between the top flange and channel lip and once released is gripped therebetween.

DETAILED DESCRIPTION OF THE PREFERRED EMBODIMENTS

Figure 1:
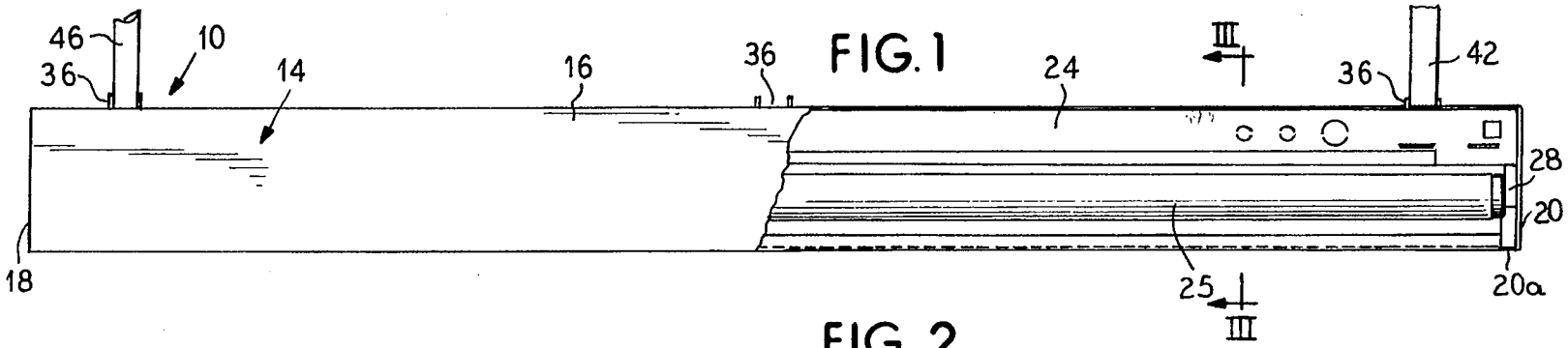
FIG. 1 is a front elevational view of a light assembly of the present invention with a portion of a front panel removed for clarity.

FIG. 1 shows a lighting assembly 10 of the present invention having a housing 14 having side panels 16, 17 and end panels 18, 20. A cableway enclosure 24 is provided along the length of the housing 14. Within the cableway enclosure 24 can be mounted wires and voltage regulation such as a transformer, for applying proper voltage to both ends of a tubular lamp 25. At opposite ends of the cableway 24 are mounted socket assemblies 28, 30 (see FIG. 3) for holding the lamps 25. Parallel lamps 25 and parallel sockets 28, 30 can be provided.

A plurality of cross brackets 36 are provided between side panels 16, 17 in spaced apart relation along the length of the housing 16 to attach the cableway enclosure 24 to the housing and to reinforce the overall integrity of the unit. The housing 14 can be hung by rods, or cables, or conduits 42, 46 or the like. If conduit is used for 42, 46, the power wires for the unit can be carried in these conduits. The conduits 42, 46 or other hanging structure can be attached to the cross brackets 36.

Figure 2:
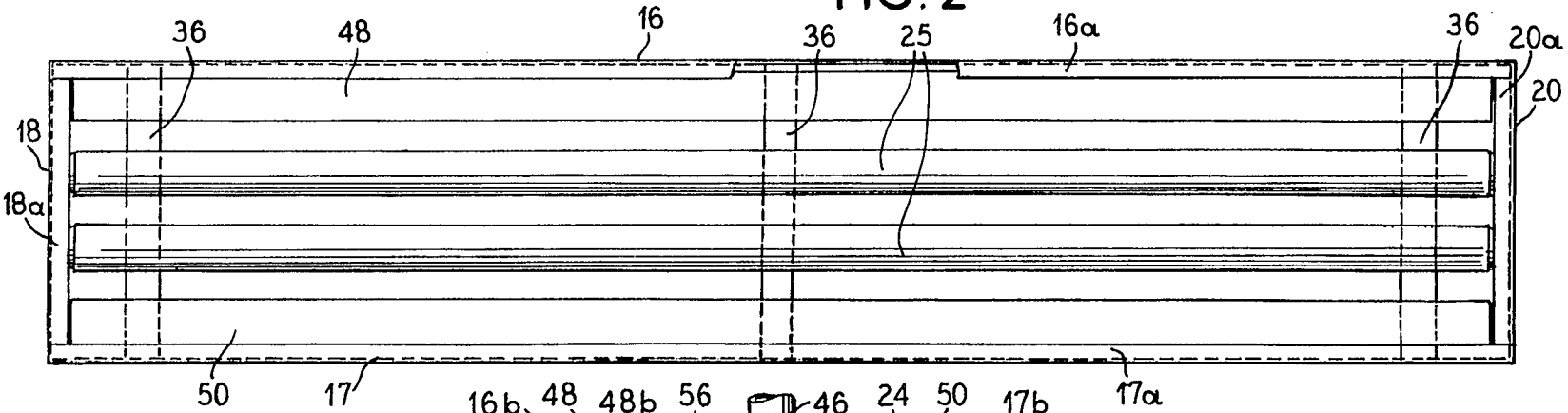
FIG. 2 is a bottom view of the light assembly of FIG. 1.

As shown in FIG. 2, the side panels 16, 17 and end panels 18, 20 have inwardly directed bottom flanges 16*a*, 17*a*, 18*a*, 20*a*. These bottom flanges strengthen the housing. The bottom flanges for the side panels 16, 17 are more further described with regard to FIG. 3.

Figure 3:
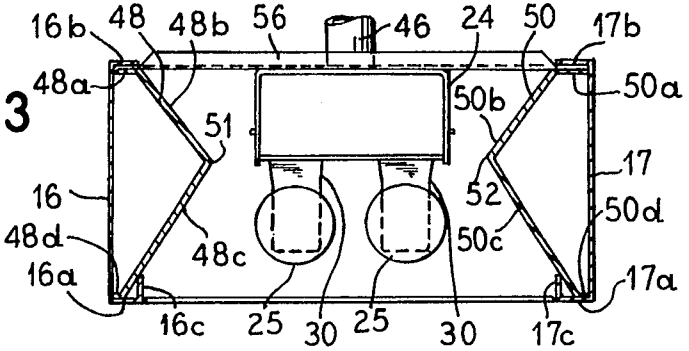
FIG. 3 is a sectional view taken generally along line III—III of FIG. 1.

As shown in FIGS. 2 and 3, side reflectors 48, 50 are interfit along the length of the side panels 16, 17 outside of the tubes 25, 25.

As shown in FIG. 3, the reflectors 48, 50 are generally V-shaped, having apices 51, 52 respectively, but also having a bent-off upper flange 48*a*, 50*a* respectively. The side panels 16, 17 have inwardly turned top flanges 16*b*, 17*b* respectively which add rigidity to the panels and also serve to abut the upper flanges 48*a*, 50*a* of the reflectors. The top flanges 16*b*, 17*b* preferably have an approximate equal width to the upper flanges 48*a*, 50*a* of the reflectors to insure a proper assembly. The bottom flanges 16*a*, 17*a* of the side panels 16, 17 have upwardly turned segments 16*c*, 17*c*. To install each reflector 48, 50 within the housing, the top flange 48*a*, 50*a* is abutted against the top flange 16*b*, 17*b* and reflecting segments 48*b*, 48*c*, 50*b*, 50*c* which form each generally V-shape are resiliently deflected toward each other, 48*b* toward 48*c*, 50*b* toward 50*c*, until the reflecting segment 48*c*, 50*c* can be snapped within the channel formed by the bottom flange 16*a* and the upwardly turned segment 16*c*. The reflectors 48, 50 each can also have bottom turned portions 48*d*, 50*d* which fit each tightly within the channels.

The simple shape of the V-shaped reflector allows for quick assembly and change-out. Where the ratio of the light reflected up versus the light reflected down needs to be adjusted, a replacement reflector having, for example, different curvature or different height of its apex with respect to the tube can be snapped in place easily "in the field". A translucent lens or panel 56 can be applied on a top side and/or bottom side of the housing 14 as needed.

Although the present invention has been described with reference to a specific embodiment, those of skill in the art will recognize that changes may be made thereto without departing from the scope and spirit of the invention as set forth in the appended claims.

I claim as my invention:

1. A housing for holding at least one tubular lamp, comprising:

a first side wall;

a second side wall;

end walls connecting said first and second side walls forming an enclosed perimeter having a top opening and a bottom opening;

said first and second side walls each having inwardly turned angled off top and bottom flanges; and a first V-shaped reflector and a second V-shaped reflector arranged on opposite lateral sides of the at least one tubular lamp held by the housing with apices generally pointing toward the at least one tubular lamp, said first and second reflectors resiliently held between the inwardly turned top and bottom flanges of said first and second side walls respectively.

2. The housing according to claim 1, wherein one of said top and bottom inwardly turned flanges of said first and second side walls comprises a vertically turned end portion forming a channel for capturing one end of a respective V-shaped reflector.

3. The housing according to claim 1, wherein one of said V-shaped reflectors comprises a horizontally turned end portion which, when installed, presses against one of said top and bottom inwardly turned flanges.

4. A housing for holding at least one tubular lamp, comprising:

a first side wall;.

a second side wall;

end walls connecting said first and second side walls forming an enclosed perimeter having a top .opening and a bottom opening;

said first and second side walls each having inwardly turned top and bottom flanges; and a first V-shaped reflector and a second V-shaped reflector arranged on opposite lateral sides of the at least one tubular lamp held by the housing with apices generally pointing toward the at least one tubular lamp, said first and second reflectors resiliently held between the inwardly turned top and bottom flanges of said first and second side walls respectively;

a cable channel spanning a length of said first and second side walls and terminating at said end walls, said cable channel further providing socket assemblies for holding ends of said tubular lamp; and a plurality of cross brackets spanning said top opening and connecting said first and second side walls and said cable channel.

5. The housing according to claim 4, wherein said housing is at least partially supported by a hanging member attached to one of said cross brackets.

6. The housing according to claim 1, wherein said first V-shaped reflector and said second V-shaped reflector comprise bent-off flange portions at opposite ends thereof, said bent-off flange portions flushly abuttable to said top and bottom flanges of said first and second side walls respectively.

7. The housing according to claim 6, wherein said bottom flanges of said first and second side walls each comprise an upwardly turned lip portion forming a channel for capturing said bottom flange portions of said first and second V-shaped reflectors.

8. The housing according to claim 7, wherein said first V-shaped reflector and said second V-shaped reflector have substantially straight reflecting surfaces.

9. A light assembly comprising:

a housing having a first side wall and a second side wall connected together at opposite ends by end walls, the housing forming a top opening and a bottom opening along its length;

a tubular lamp spanning a length of said housing;

electrical means for providing power to said tubular lamp, electrically connected to said tubular lamp at opposite ends thereof; and a first reflector having a V-shape with straight segments and having its apex directed toward said tubular lamp for reflecting light emitted from said tubular lamp downwardly and upwardly through said top and bottom openings respectively.

10. The light assembly according to claim 9 further comprising a second reflector arranged on an opposite side of said tubular lamp as said first reflector and arranged and configured identically.

11. The light assembly according to claim 10, wherein said first and second side walls comprise top and bottom inwardly directed flanges, and said first and second reflectors are arranged and sized to be resiliently compressed in a vertical direction to be held between said top and bottom inwardly directed flanges.

12. The light assembly according to claim 11, wherein said first and second reflectors comprise a horizontal portion bent-off from one of said segments which form the V-shaped reflector, said horizontal portion arranged to flushly abut one of said top and bottom inwardly directed flanges.

13. The light assembly according to claim 12, wherein said one of said top and bottom flanges abutting said horizontal portion has an equal width with said horizontal portion.

14. The light assembly according to claim 12, wherein a respective opposite one of said top and bottom inwardly directed flanges comprises a vertically bent-off lip at a distal end thereof to form a channel for capturing an end of a respective other segment of said V-shaped reflector.

15. The light assembly according to claim 9, wherein said first side wall and said second side wall of said housing each comprise top and bottom inwardly directed flanges; and said first reflector and said second reflector comprise outwardly bent-off portions at top ends thereof, said outwardly bent-off portions arranged to flushly abut an underside of said top inwardly directed flanges of said first and second side walls respectively.

16. The light assembly according to claim 15, wherein said first and second reflectors comprise outwardly turned end portions each opposite one of said outwardly bent-off portions respectively, said outwardly turned end portions arranged to flushly abut a top side of said bottom inwardly directed flanges of said first and second side wall respectively.

17. The light assembly according to claim 16, wherein said bottom inwardly directed flanges further comprise an upwardly turned distal end portion forming a channel, said channel capturing one of said outwardly turned end portions of said first and second reflectors respectively.

18. A method for installing side reflectors in a housing for a tubular lamp to direct light both upwardly and downwardly through top and bottom openings of the housing comprising the steps of:

providing side walls of said housing having inwardly directed flanges at a top and bottom thereof;

providing a V-shaped reflector sized and adapted to be slightly compressible in a folding direction between legs of the V-shape;

inserting said reflector into said housing; slightly compressing said reflector to diminish its overall height;

interfitting said reflector between said top and bottom inwardly directed flanges of said side wall and releasing compression on said reflector to cause said reflector to be resiliently held between said inwardly directed flanges.

19. The method according to claim 18 comprising the further steps of:

providing that one of said inwardly directed flanges has a vertically bent-off distal end portion forming a channel;

providing that said reflector has a bent-off segment at one end thereof to flushly abut said respective other inwardly directed flange;

when inserting said reflector, flushly abutting said bent-off segment with said respective other inwardly directed flange; and when compressing said reflector, inserting a respective other end of said reflector into said channel formed by said one of said inwardly directed flanges.

20. The method according to claim 19 comprising the further step of providing that said reflector has a second bent-off segment at an opposite end thereof from said bent-off segment, to flushly abut said one of said inwardly directed flanges within said channel.

21. The housing according to claim 3, wherein said respective other of said V-shaped reflectors comprises a horizontally turned end portion which, when installed, presses against one of said top and bottom inwardly turned flanges.

22. A housing for holding at least one tubular lamp, comprising:

a first channel-shaped side wall having an inwardly turned top flange and an inwardly turned bottom flange;

a second channel-shaped side wall having an inwardly turned top flange and an inwardly turned bottom flange;

end walls connecting said first and second side walls forming an enclosed perimeter having a top opening and a bottom opening; and a first V-shaped reflector and a second V-shaped reflector arranged on opposite lateral sides of the at least one tubular lamp held by the housing with apexes generally pointing toward the at least one tubular lamp, said first and second reflectors having bent-off top portions, directed outwardly from the at least one tubular lamp, and said bent-off portions pressed flushly against said top flanges of said first and second side wall, and a bottom end of said reflectors resiliently pressed against said bottom flanges of said first and second side walls.

23. The housing according to claim 22, wherein said bottom end of said reflectors comprises a second bent-off portion directed outwardly from said tubular lamp, said second bent-off portions resiliently pressed flushly against said bottom flanges of said first and second side walls.

* * * * *